United States Patent [19]

Shvartsburd

[11] Patent Number: 5,052,159

[45] Date of Patent: Oct. 1, 1991

[54] MODULAR DECKING PANEL

[76] Inventor: Gregory Shvartsburd, #308, 17304 - 105 Ave., Edmonton, Alberta, Canada, T5S 1G4

[21] Appl. No.: 535,167

[22] Filed: Jun. 8, 1990

[51] Int. Cl.[5] ..... F16B 2/18

[52] U.S. Cl. ..... 52/285; 52/825; 52/826

[58] Field of Search ..... 52/824, 825, 826, 822, 52/732, 721, 479, 285

[56] References Cited

U.S. PATENT DOCUMENTS 1,235,431 7/1917 Burrowes ..... 52/826

FOREIGN PATENT DOCUMENTS 996340 of 1951 France ..... 52/825

1158661 of 1958 France ..... 52/825

*Primary Examiner*—Richard E. Chilcot, Jr.

*Assistant Examiner*—Joanne C. Downs

*Attorney, Agent, or Firm*—Terry M. Gernstein

[57] ABSTRACT

An elongated modular decking panel of substantially C-shaped cross-section is provided. The panel comprises a central section, coextensive side angles extending downwardly from the side edges of the central section, and two transverse angle members located in the opening at each end of the plate. One of each such two end angle members is attached to the inwardly extending legs of the side angles. The other of each such two end angle members is attached to the undersurface of the central section. Each of the two end angle members at each end of the panel are spaced apart from one another to form a transverse gap. Such panels may be joined to one another and to a frame of posts and beams to create a temporary parkade.

13 Claims, 2 Drawing Sheets

MODULAR DECKING PANEL

BACKGROUND OF THE INVENTION

The invention has to do with structural load-bearing, steel decking panels which find application in temporary parkades and the like. Such panels would be used in conjunction with a support frame formed of I-beams.

For this purpose the panel needs to be of sufficient strength to support a load, such as an automobile, while bridging a relatively wide gap between adjacent support beams. In addition, it is desirable that the panels be adapted to be bolted to each other and to the support beams and to enable wiring to be strung through them.

| Prior art patents of interest include: | |
|---|---|
| U.S. Pat. No. 4,603,532 | Watson |
| U.S. Pat. No. 1,996,641 | Coleman |
| U.S. Pat. No. 1,883,141 | Walthers |
| U.S. Pat. No. 3,093,216 | Dunham |

SUMMARY OF THE INVENTION

In accordance with the invention, a steel decking panel of substantially C-shaped cross-section is provided. The panel is formed from a single steel plate so that the side angles are integral with the central section. The panel is elongated, having a length that is several times its width. A pair of angle members is positioned in each of the end openings of the panel. More particularly, one angle member is attached to the inwardly projecting legs of the panel side angles and the other angle member is attached to the underside of the panel central section. The two angle members extend transversely across the panel end opening in parallel relationship and are spaced apart vertically to form a transverse gap.

The C-shaped panel is structurally strong and rigid and is capable of supporting a vehicle. The transverse angle members enable end to end bolting of panels and the gaps enable wiring to extend axially through the panels. The side angles function to bear against the support beams and enable bolts to be used to connect the panels with the frame.

DESCRIPTION OF THE PREFERRED EMBODIMENT

Figure 1:
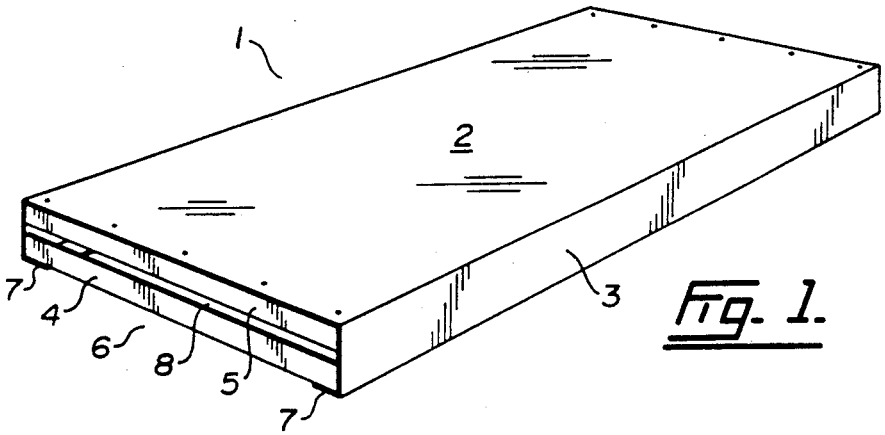
FIG. 1 is a perspective view of a panel in accordance with the invention.
Figure 2:
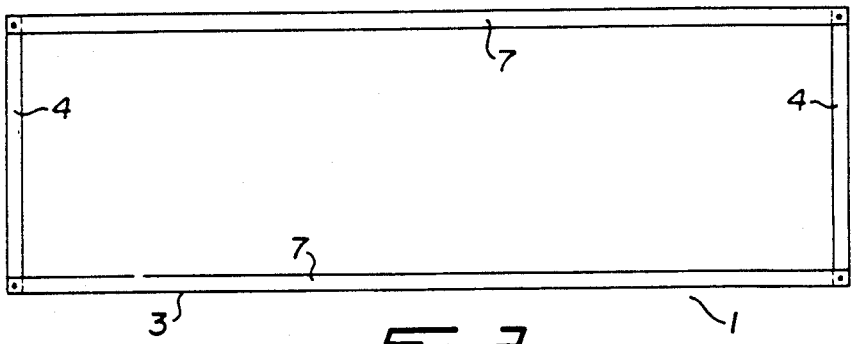
FIG. 2 is a bottom plan view of the panel.
Figure 3:
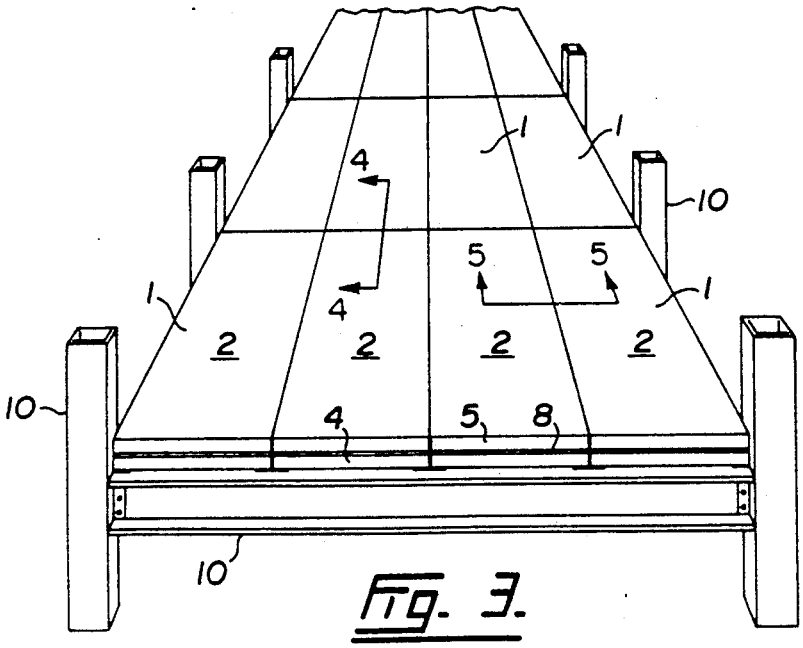
FIG. 3 is a perspective of a plurality of panels supported by a frame.

Referring to FIGS. 1 and 2, the panel 1 comprises a rectangular central section 2 and coextensive downwardly depending side angles 3. The central section 2 is elongated, having a length that is several times its width. The central section 2 and side angles 3 are integral, being formed of a single plate of steel. The panel 1 is rigid and has sufficient strength to withstand a structural load such as that of a car supported by the panel.

A pair of angle members 4,5 are located in the opening 6 at each end of the panel 1. The angle members 4,5 of each pair extend horizontally across the opening 6. The lower angle member 4 is attached to and supported by the inwardly extending legs 7 of the side angles 3. The upper angle member is attached to the central section 2 along its undersurface. The angle members 4,5 are spaced apart vertically to form a transverse gap 8.

Figure 4:
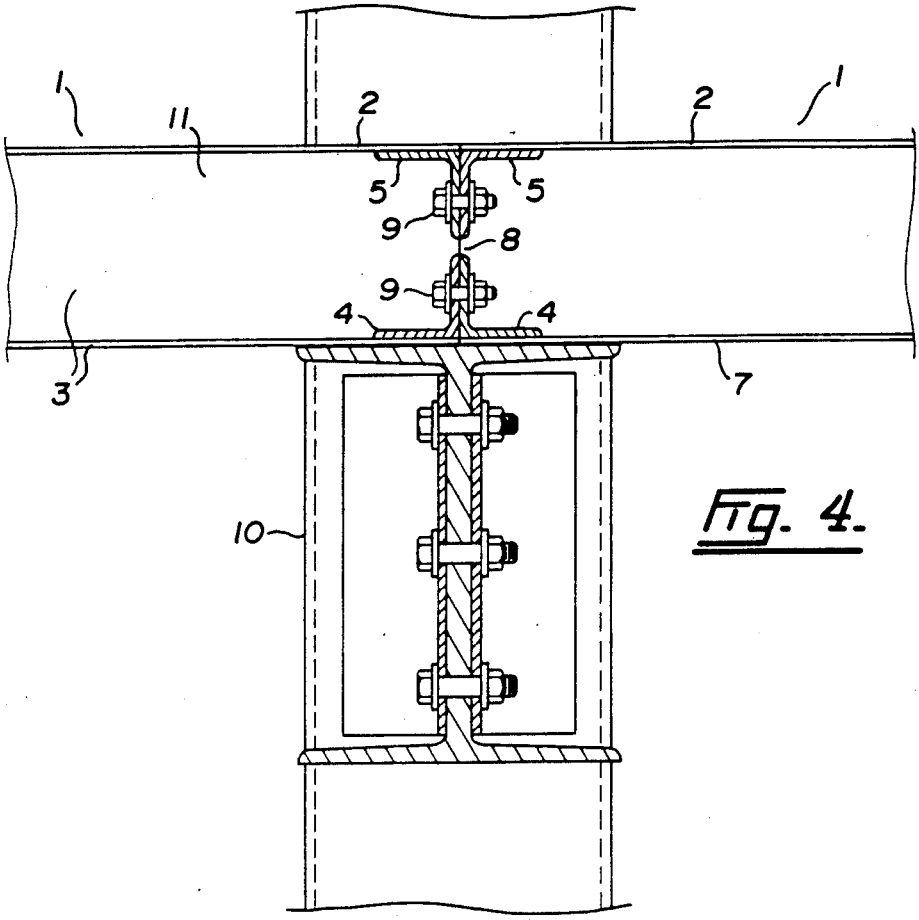
FIG. 4 is a cross-sectional view taken along the line 4—4 of FIG. 3.
Figure 5:
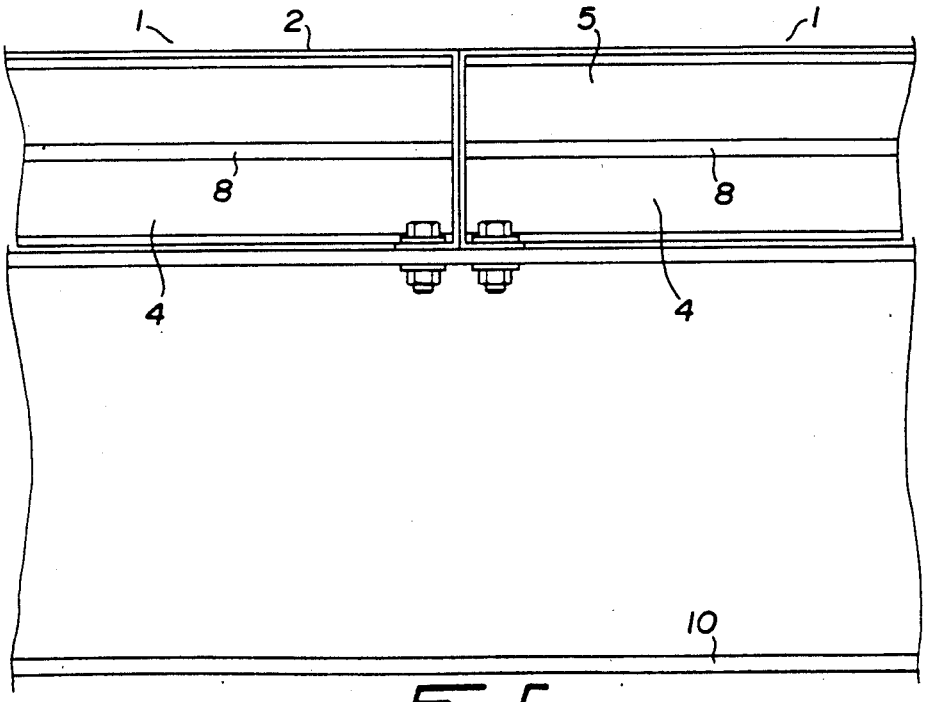
FIG. 5 is a cross-sectional view taken along the line 5—5 of FIG. 3.

In use, the panels 1 are joined end to end by bolts 9 extending through the angle members 4,5, as shown in FIG. 4. The panels 1 bear on the support frame !0 and may be bolted thereto through the side angle legs 7. Similarly the panels 1 may be bolted side by side through the side angle vertical legs 11. Wiring may be strung through the gaps 8.

The scope of the invention is defined by the following claims.

The embodiments of the invention in which an exclusive property or privilege is claimed are defined as follows:

1. A modular steel decking panel comprising:

an integral, one-piece central section that is polygonal in peripheral shape and which includes a central element having side edges, end edges, a length dimension measured between said end edges, a width dimension measured between said side edges, said length dimension being greater than said width dimension, a longitudinal center axis extending between said side edges and along said length dimension; said one-piece central section further including an L-shaped side element located on each central element side edge, each side element having a leg spaced from said central element and extending toward said longitudinal center axis; a lengthwise extending gap located between each L-shaped side element leg and said central element; a first angle member attached to said central element adjacent to each central element end edge and extending along said central element width dimension; a second angle member attached to said L-shaped side element legs adjacent to each central element end edge and extending along said width dimension adjacent to said first angle member, said first and second angle members being located in each of said lengthwise extending gaps and being spaced apart from each other and forming a widthwise extending gap therebetween.

2. The modular steel decking panel defined in claim 1 wherein each of said L-shaped side elements extends for essentially the entire length dimension of said central element.

3. The modular steel decking panel defined in claim 2 wherein each of said angle members extends for essentially the entire width dimension of said central member.

4. The modular steel decking panel defined in claim 3 further including bolt holes defined in each of said L-shaped side elements.

5. The modular steel decking panel defined in claim 4 further including bolt holes defined in each of said angle members.

6. The modular steel decking panel defined in claim 5 further including bolt elements located in said L-shaped side element bolt holes.

7. The modular steel decking panel defined in claim 6 further including bolt elements located in said angle member bolt holes.

8. The modular steel decking panel defined in claim 3 wherein adjacent angle members include outer surfaces that are coplanar with each other.

9. The modular steel decking panel defined in claim 8 wherein said central element is planar.

10. The modular steel decking panel defined in claim 9 wherein each of said L-shaped side element legs is oriented parallel to said central element and include surfaces to which said angle members are attached that are coplanar with each other.

11. The modular steel decking panel defined in claim 10 wherein each of said L-shaped side elements is one-piece.

12. The modular steel decking panel defined in claim 11 wherein said central element length dimension is substantially greater than said central element width dimension.

13. The modular steel decking panel defined in claim 12 further including a support frame attached to said central element.

* * * * *